United States Patent [19]

Best

[11] 4,026,132

[45] May 31, 1977

[54] HIGH SECURITY LOCK

[76] Inventor: Walter E. Best, c/o Best Lock Corporation, P.O. Box 103, Indianapolis, Ind. 46206

[22] Filed: Aug. 13, 1975

[21] Appl. No.: 604,180

[52] U.S. Cl. ..... 70/9; 70/34; 7/DIG. 60

[51] Int. Cl.[2] ..... E05B 65/48; E05B 67/36

[58] Field of Search ..... 70/2, 3, 4, 5, 6, 7, 70/8–15, 18, 23, 32, 33, 34, 229–232, 337, 339, 395, 419, DIG. 60, 423–428

[56] References Cited

UNITED STATES PATENTS

| | | | |
|---|---|---|---|
| 1,907,524 | 5/1933 | Ellenberger | 70/230 X |
| 2,544,305 | 3/1951 | Finke | 70/337 X |
| 2,834,195 | 5/1958 | Stackhouse | 70/339 |
| 3,820,360 | 6/1974 | Best | 70/6 |

*Primary Examiner*—Robert L. Wolfe
*Attorney, Agent, or Firm*—Jenkins, Hanley & Coffey

[57] ABSTRACT

A high security lock which is guarded against picking. A disk shaped body is fixed to a hasp and contains a diametric bore with a lock core-receiving chamber at each end. Two cores in such chambers have key plugs which lie on the axis of the bore and are both solidly connected to each other through a rotary bolt which lies between them. The bolt partially intersects a post-receiving recess in the rear face of the body so as to lockingly engage a grooved post over which the hasp is engaged, and has a side-cut-out to clear such post when the bolt is rotated with both of the two key plugs to an unlocked position. A guard casing is rotatably mounted over the lock body and the two lock cores, and has only a single key opening. Operation requires rotating the guard to one position which exposes one key slot, inserting a stub key in that key slot, then rotating the guard to another position which exposes the other key slot, and then inserting a second key and using it to rotate both of the interconnected key plugs and the bolt through which they are connected. Since the two key slots are exposed only one at a time, they cannot be simultaneously picked, and the solid interconnection between the key plugs prevents picking one core and leaving it partly turned while picking the other core.

20 Claims, 7 Drawing Figures

HIGH SECURITY LOCK

BACKGROUND OF THE INVENTION

This invention relates to a high security lock in the nature of a padlock, which is guarded against picking.

The prior art shows numerous attempts to improve the security provided by padlocks. Conventional padlocks have been made heavier and stronger, and provided with shrouds and guards to shield them from attack by cutting and leverage tools. Locks for analogous purposes have been made in special shapes so as to form a protective enclosure about the lock hardware to which they are applied. My prior U.S. Pat. No. 3,820,360 shows a round lock for such a purpose. Such locks, however, are subject to picking, and various measures have been tried to improve their pick resistance, for example, by the use of specially shaped pin tumblers. The present invention provides a lock which is guarded against picking, and which in its preferred form also provides a protective enclosure about the post or other element to which it is applied.

SUMMARY OF THE INVENTION

A pick-resistant lock of the present invention employs two lock tumbler mechanisms or cores each having a separate key plug, and the two key plugs are interconnected internally of the lock in an arrangement such that two keys must be present in the two lock cores if either core is to be moved. This arrangement in itself provides the benefit of requiring two keys to operate the lock, when that function only is required. In accordance with the present invention, however, the lock containing the two cores is provided with a guard which exposes only one key slot at a time. The guard is movable between one position in which it exposes the key slot of one for key insertion and covers and blocks the other core against key insertion, and a second position in which it exposes the key slot of the other core for key insertion and covers and blocks the first core. Operation is effected by positioning the guard to expose the first core, inserting a stub key in such core which will not interfere with subsequent movement of the guard, then moving the guard to its second position to expose the second core, and then inserting an operating key. The operating key can then turn the interconnected two key plugs and operate a bolt or other fastening mechanism. In the preferred arrangement, the two cores are mounted with their key plugs at opposite ends of, and on the axis of, a diametric or chordal bore through a disk-shaped lock body fixed to a hasp or the like, and the two key plugs are solidly interconnected by a rotary control member mounted in the bore between their inner ends. Preferably, such rotary member itself forms a locking bolt, as for releasable engagement with a grooved post positioned in an intersecting bore, but such member may be arranged to operate some other bolt or fastening mechanism. In such preferred arrangement, the fixed lock body is surrounded by a rotary guard which has a single key opening and is rotatable to align that opening separately with the two diametrically opposite key slots.

BRIEF DESCRIPTION OF THE DRAWINGS

The accompanying drawings illustrate the invention and show an exemplifying embodiment. In such drawings.

DETAILED DESCRIPTION OF THE PREFERRED EMBODIMENT

Figure 1:
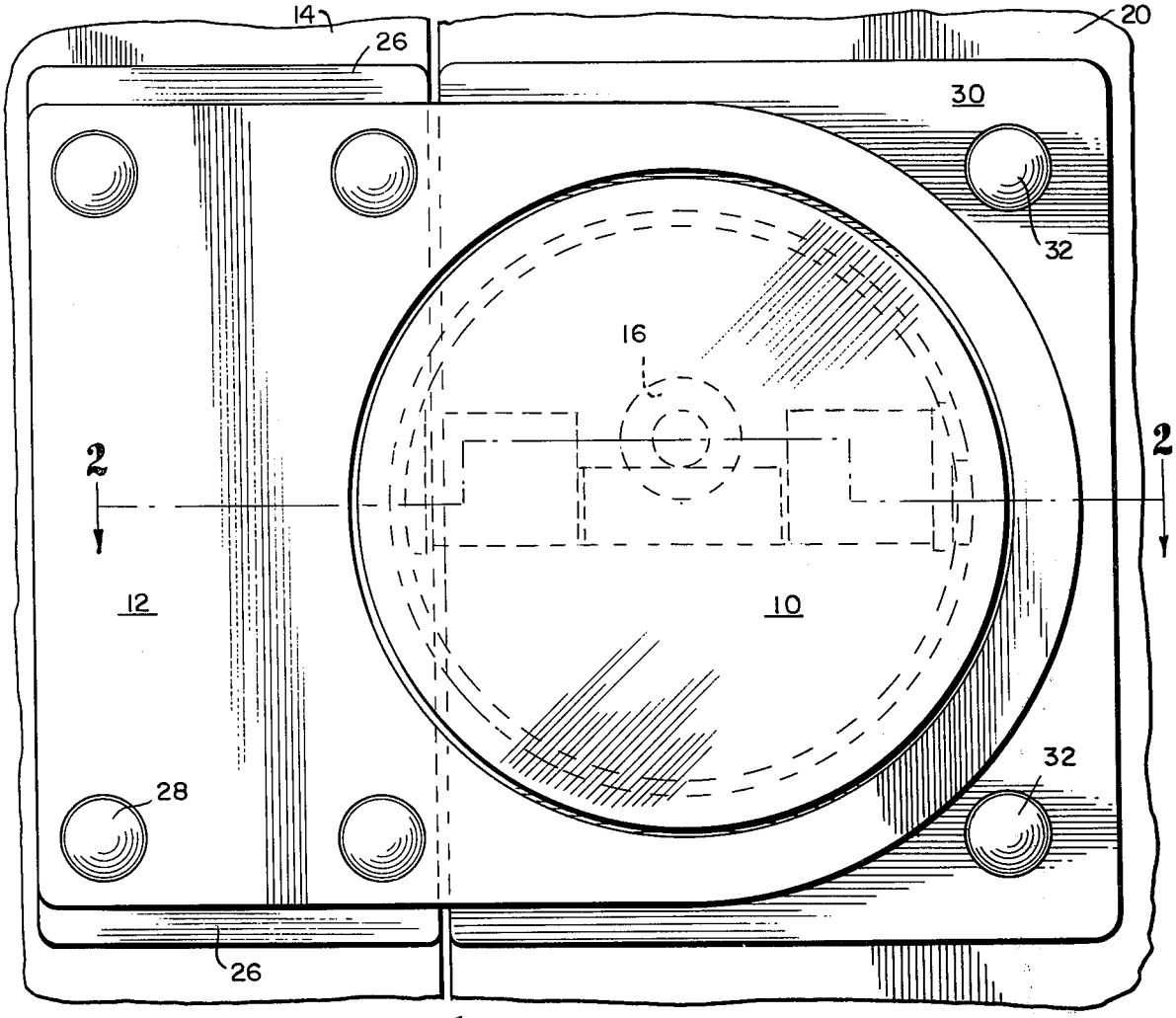
FIG. 1 is a front elevation of a lock mechanism embodying the invention in which the lock body is fixed to a hasp which engages over a keeper post.

The lock mechanism comprises a round lock 10 carried by a hasp 12 mounted on a door 14. The lock and hasp engage a post 16 which has a circumferential groove 18 adjacent its end and is secured to a doorjamb by a threaded stem 22 and nut 23. The hasp 12 is mounted on the door 14 against a mounting plate 26, by means of mounting bolts 28. The keeper post 16 is mounted against a mounting plate 30 secured to the doorjamb by bolts 32. The hasp 12 projects beyond the edge of the door and lies against the front face of the post mounting plate 30 when the door is closed, and contains a central opening 34 which closely engages about the post 16. The hasp desirably also includes a guard plate 24 fixed on the face of the hasp 12 which closely surrounds the rear edge of the lock 10 to guard against insertion of a prying tool beneath that lock.

Figure 6:
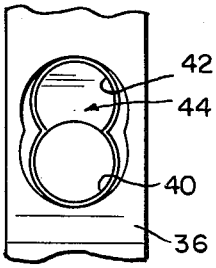
FIG. 6 is a partial side elevation of the lock body.
Figure 7:
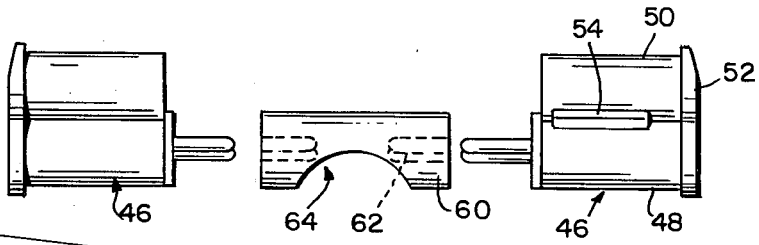
FIG. 7 is an exploded view showing the relationship of the two lock cores and the rotary bolt.

That lock 10 comprises a disk-shaped body 36 which has a through bore 38 extending forward from its rear face, of a size to receive the post 16. The bore 38 is slightly above the center of the body 36 and is intersected by a diametric bore 40 which cuts across the lower side of the bore 38 to a depth of about one-half the diameter of the bore 40. Each end portion of the diametric bore 40 is enlarged by a side cavity, preferably in the form of a parallel, overlapping short bore 42 of equal diameter, to form a core-receiving chamber 44 of figure-8 cross section as shown in end elevation in FIG. 6.

Figure 2:
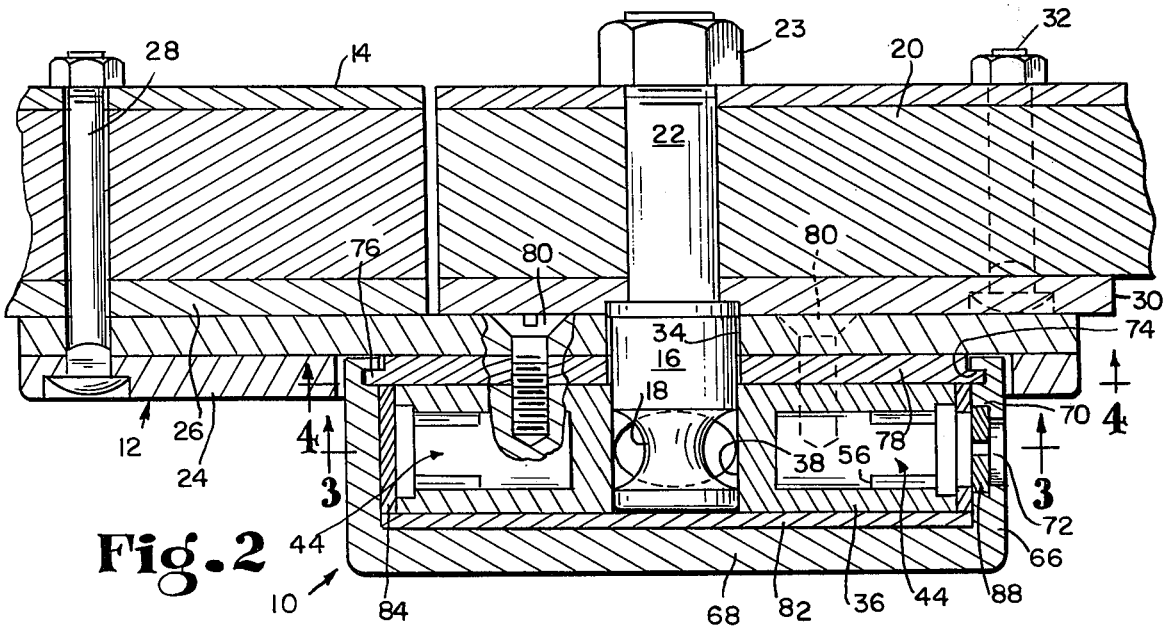
FIG. 2 is a horizontal section of the lock mechanism of FIG. 1, taken on the line 2—2 of FIG. 1.

Each such chamber 44 receives a lock core 46 of a standard type having a figure-8 cross section to match the chamber 44, with a lower lobe 48 containing a key plug, and an upper lobe 50 containing a series of pin tumblers. The front of the core carries a face plate 52, and the bores 40 and 42 are countersunk at their outer ends to receive such plate. The core has a retaining lug 54 which is retractable by means of a special control key and which engages behind a shoulder 56 (FIG. 2) in the core-receiving chamber. Such shoulder 56 is formed by milling away the ridge between the two overlapping bores 40 and 42 over the rear portion of the chamber.

Figure 3:
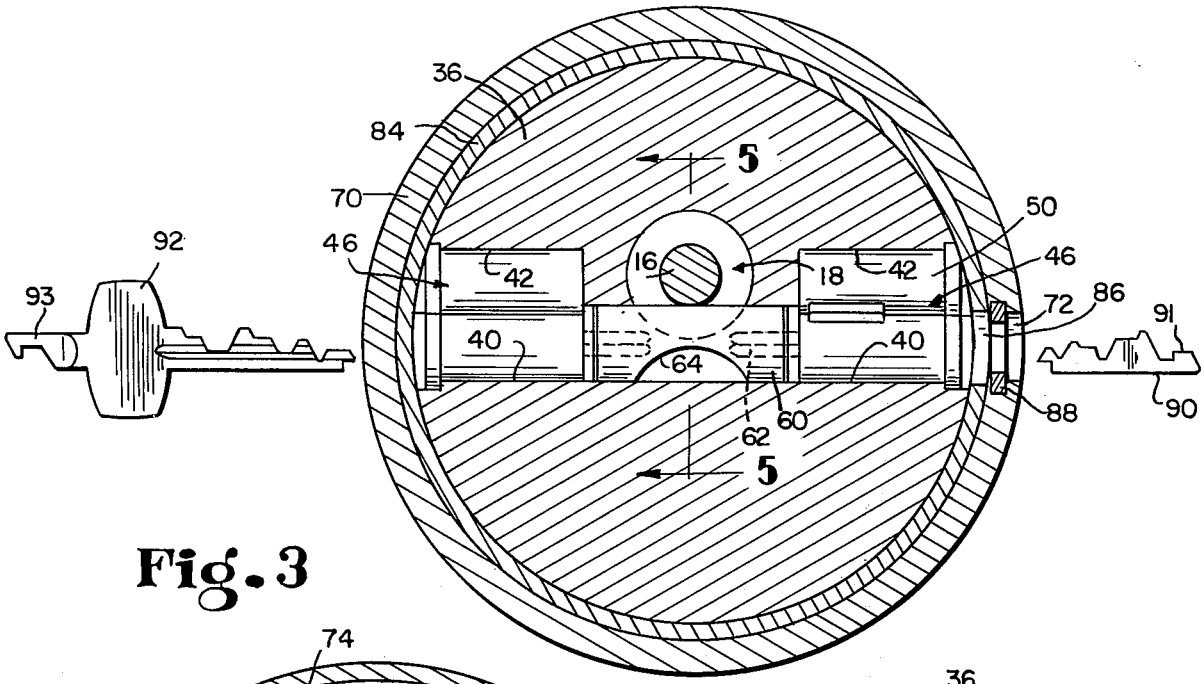
FIG. 3 is a vertical section, taken on the line 3—3 of FIG. 2.
Figure 4:
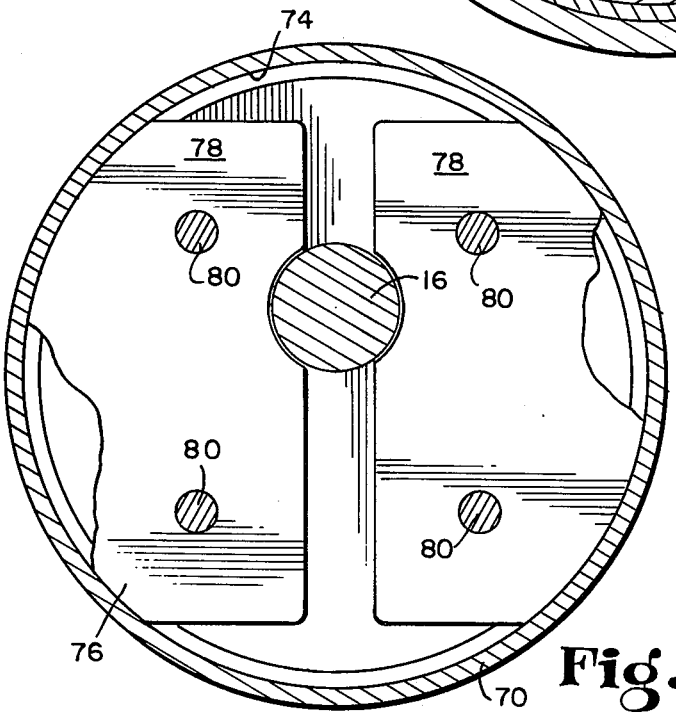
FIG. 4 is a vertical section, taken on the line 4—4 of FIG. 2.
Figure 5:
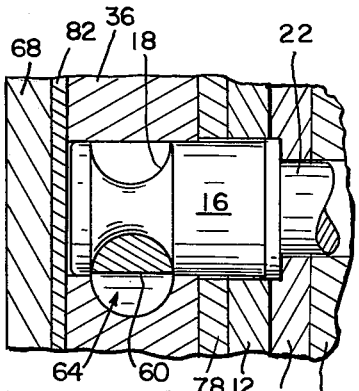
FIG. 5 is a vertical axial section, taken on the line 5—5 of FIG. 3.

A rotary bolt 60 is mounted in the bore 40 between the inner ends of the cores 46, and is operatively connected to the key plugs of those cores by pairs of throw pins 62. In normal locking position, as shown in FIGS. 3 and 5, the rotary bolt 60 extends in intersecting relation across the side of the post-receiving bore 34, to make locking engagement with the circumferential groove 18 of the post 16 received in such bore. The bolt has an arcuate side cut-out 64, and when the bolt is rotated 180° by key-actuation of the key plugs of the cores, such cut-out 64 conforms with the surface of the post-receiving bore 34 and clears the post 16 so that the post can be removed and inserted as desired. The rotary bolt 60, by its connection to the key plugs of both cores 46, solidly connects those two cores with each other, so that operation requires the presence of two keys in the two cores. The lock mechanism so far described may be used as such when the use of two keys is the only function required, but the present invention contemplates additional function and mechanism.

The lock body 36 is surrounded by a guard casing 66 which is rotatable on the axis of the lock body 36. Such casing or guard 66 is generally cup-shaped and comprises a front wall 68 and a peripheral wall 70 which surrounds the periphery of the body 36. The peripheral wall contains a single key opening 72 and is rotatable to bring that opening into registry with the two key slots one at a time. To secure the guard 66 in place over the body 36, the rear edge of the peripheral wall 70 contains an internal groove 74 which is engaged by mating peripheral flanges 76 on a pair of D-shaped retaining plates 78 mounted against the rear face of the lock body 36. The inner edges of the D-plates 78 are shaped to closely surround the post 16 so that that post blocks them against retraction from the groove 74 when the post is in place. The D-plates 78 are secured to the lock body 36 and the lock body secured to the hasp 12 by a set of screws 80. Such screws fix the lock 10 to the hasp, but allow the guard 66 to rotate on the stationary body 36.

Desirably, the guard 66 contains an armor lining to prevent attack on the lock mechanism by drilling. To this end, the front wall 68 of the guard may be lined with an armor plate 82 of hardened steel, and the peripheral wall 70 of the guard may be lined with an armor ring 84. The single key opening in the peripheral wall 70 of the guard 66 is necessarily a round opening to permit rotation of a key therein. The armor lining 84 of the peripheral wall contains a corresponding round opening 86 in registry with the opening 72. A guard disk 88 is rotatably mounted in the wall 70 at the inner end of the key opening 72 and contains a narrow slot to pass the key, but serves to obstruct drilling through the key opening.

Operation of the lock mechanism is as follows: With the parts in the positions shown, the hasp 12 stands engaged over the keeper post 16, and the rotary bolt 60 has its solid side section engaged in the circumferential groove 18 of that post to secure the lock body 36 in locked engagement with the post and hence to secure the hasp 12 and door 14 in locked relation with the jamb 20. Release from this locked relationship requires the use of two keys, namely a stub key 90 shown at the right in FIG. 3 and an operating key 92 shown at the left in FIG. 3. To facilitate removal of the stub key 90, its outer end is formed as a hook 91, and the key 92 carries a projecting extension forming a matching hook 93. To release the lock, it is necessary first to rotate the guard 66 to a position in which its key opening 72 is aligned with the key slot of the key plug in the core 46 to the right in FIG. 3. The stub key 90 is then inserted, and moves to a position in which it lies wholly within the core 46 and within the inner periphery of the guard ring 84, in non-interfering relation with the guard. The guard 66 is then rotated 180° to align its single key opening 72 with the key slot in the key plug of the opposite core 46, at the left in FIG. 3. The operating key 92 is then inserted in that key plug. With the two keys now lying within the two cores, the tumblers of those cores are positioned to release the key plugs for rotation, and it is possible to rotate the key 92. Such rotation rotates not only its own key plug, but also rotates the interconnecting rotary bolt 60 and the key plug of the opposite core 46. Such rotation through 180° carries the cut-out 64 into facing relation with the post-receiving bore 34 and clears that bore and disengages the bolt from the post 16. The lock 10 and hasp 12 can then be moved off the keeper post 16 and the door 14 can be swung to open position. To re-engage the lock 10, the door 14 is swung shut, and the hasp and lock body are engaged over the keeper post 16 while the key plugs of the two cores 46 and the rotary bolts 60 are rotated to their release position 180° from that shown in the drawings. This allows the bolt 60 to pass the end of the post 16. The operating key 92 is then rotated 180° to its locked position, which re-engages the bolt 60 in the post groove 18 and brings the key plugs and tumblers of both lock cores to their normal position and permits the key 92 to be withdrawn. The guard 66 is then rotated to again align its key opening 72 with the key slot in the key plug of the opposite core 46, the hook 93 is inserted through the slot of the guard plate 88 and hooked over the hook 91 on the stub key 90, and that stub key 90 is thereby withdrawn from the second core 46. Both cores 46 are then in their normal locked condition.

Because there is only a single key opening 72 in the guard 66, the key slots of the two cores 46 can never be simultaneously exposed for picking. Moreover, because the two key plugs are solidly interconnected against relative rotation by the interconnecting bolt 60, it is not possible to pick one core 46 and turn it sufficiently to hold its tumblers in picked condition in some way while the guard 66 is turned to expose the other core for picking. The lock is thus effectively guarded against picking.

It will be understood that the embodiment shown in the drawings and described above is the presently preferred embodiment, but that it is contemplated that two or more interconnected cores may be combined in other ways with a guard which prevents simultaneous access to such cores for picking. For example, a rotary guard might contain two key openings with a different spacing than that of the key plugs so that only one could be aligned with a key plug at any one time, or the cores might both face the same direction and be covered by a slidable guard, or various other arrangements might be used. It is intended that the invention be protected in a broader scope, as defined in the appended claims.

I claim:

1. A pick-resistant lock, comprising a lock body, a plurality of key-actuated locking mechanisms mounted in said lock body, each including a rotatable key plug having a key-slot, means interconnecting the key plugs of said mechanisms for joint rotation and preventing their independent rotation, and a guard mounted on said lock body for movement between one position in which it exposes the key slot of one locking mechanism for key insertion therein while covering the key slot of another locking mechanism, and a second position in which it exposes the key slot of said other locking mechanism for key insertion therein while covering the key slot of said one locking mechanism.

2. A pick-resistant lock as in claim 1 in which said guard includes a cover wall which extends across the faces of a plurality of locking mechanisms and contains a single key-insertion opening, the guard being movable to align said single key-insertion opening with the key slot of each such locking mechanism to permit insertion of a key therein while preventing insertion of a key in the key slot of another such locking mechanism.

3. A pick-resistant lock as in claim 1 in which said guard is mounted for rotary movement on said lock body.

4. A pick-resistant lock as in claim 2 in which said guard is mounted for rotary movement on said lock body.

5. A pick-resistant lock as in claim 1 in which said lock body is defined by a surface of revolution and two locking mechanisms are mounted with their key slots presented toward such surface in eccentric positions thereon, and said guard comprises a wall overlying and rotatably movable over such surface, said wall having at least one key-insertion opening therethrough, said wall in said one position of the guard having a key-insertion opening in registry with the key slot of said one locking mechanism and a key blocking portion overlying the key slot of said other locking mechanism, and said wall in said second position of the guard having a key-insertion opening in registry with the key slot of said other locking mechanism and a key-blocking portion overlying the key slot of said one locking mechanism.

6. A pick-resistant lock as in claim 1 in which said lock body is in the form of a thick round disk, there being two said locking mechanisms mounted in said disk with their key slots presented toward a surface of said disk-shaped body in eccentric positions thereon, and said guard comprising a casing surrounding the periphery of said disk and rotatably mounted thereon, said casing extending across said key slots and having at least one key insertion opening movable into registry with at least one of said key slots to expose the same for key insertion therein, the other key slot being then blocked by the casing.

7. A pick-resistant lock as in claim 6 in which the two locking mechanisms are mounted with their key slots positioned at angularly spaced points about the cylindrical periphery of the disk-shaped lock body, and said guard comprises a cylindrical wall surrounding said peripheral body surface and mounted for rotation thereon, said wall containing a single key-insertion opening and the guard being rotatable to carry such opening into registry separately with each of said key slots.

8. A pick-resistant lock as in claim 7 with the addition of an armor liner overlying the cylindrical peripheral surface of the lock body, between the said surface and the guard.

9. A pick-resistant lock as in claim 8 in which the liner is fixed to the guard to rotate with its said cylindrical wall.

10. A pick-resistant lock as in claim 6 with the addition of a supporting plate, the lock body being disposed with its rear face toward said plate and being fixed to the plate, the guard comprising a cup-shaped casing covering the front face of the body and surrounding the periphery thereof.

11. A lock mechanism, comprising a lock body having opposite outer faces, a transverse bore extending between said faces, the body being forward at the two opposite ends of the bore to define two opposite core-receiving chambers for the reception of two key-actuated lock cores, each having a key plug rotatable on the axis of the bore, a rotary control member operative to control a locking function and mounted for rotation on the axis of said bore between said two key plugs, and means for connecting said member to both said key plugs to prevent independent rotation thereof and to connect them for joint rotation with each other and said control member, said lock body containing a post-receiving recess extending inward from its rear face and cutting across one side of said transverse bore, said rotary member being shaped to lockingly engage a grooved post or the like inserted in said recess and to release the same on rotation of the member from a locking position to a release position.

12. A lock mechanism, comprising a lock housing having opposite outer faces, a transverse bore extending between said faces, the housing being formed at the two opposite ends of the bore to define two opposite core-receiving chambers for the reception of two key-actuated lock cores, each having a key plug rotatable on the axis of the bore, a rotary control member operative to control a locking function and mounted for rotation on the axis of said bore between said two key plugs, means for connecting said member to both said key plugs to prevent independent rotation thereof and to connect them for joint rotation with each other and said control member, and a guard movably mounted on said lock housing, said guard being operative always to cover at least one of the cores in said chambers and having a first position in which it covers one lock core and exposes the other for key insertion, and a second position in which it covers said other lock core and exposes the one for key insertion.

13. A lock mechanism as in claim 12 in which said chambers contain two lock cores, a stub key combinated to condition one of said cores for rotation of its key plug, and an operating key combinated to condition the other core for rotation of its key plug, said stub key being insertable in its core to a position of non-interference with said guard so as to permit such key to be inserted while its core is exposed and left in place while the guard is moved to expose the other core for insertion of the operating key in such other core.

14. A lock mechanism, comprising a lock body having opposite outer faces, a transverse bore extending between said faces, the body being formed at the two opposite ends of the bore to define two opposite core-receiving chambers for the reception of two key-actuated lock cores, each having a key plug rotatable on the axis of the bore, a rotary control member operative to control a locking function and mounted for rotation on the axis of said bore between said two key plugs, means for connecting said member to both said key plugs to prevent independent rotation thereof and to connect them for joint rotation with each other and said control member, said lock body being in the form of a thick circular disk having said outer faces on its periphery, and further comprising two lock cores in said opposite chambers, and a guard having a peripheral wall surrounding the periphery of the disk and covering said lock cores, said wall having at least one key-insertion opening, and said guard being rotatable to a first position wherein a key-insertion opening is aligned with the key plug of one lock core and the wall covers the other lock core, and a second position wherein a key-insertion opening is aligned with the key plug of such other core and the wall covers said one lock core.

15. A lock mechanism as in claim 14 further comprising a support plate to which said body is fixed with its rear face toward said plate, said guard being a cup-shaped member received over said body and secured with its rear edge substantially abutting said support plate.

16. A lock mechanism as in claim 15 in which said support plate comprises a hasp or the like adapted to be secured to a door or doorjamb, said plate and lock body assembly containing a recess for the reception of a post or the like carried by a complementary door or doorjamb, and including a bolt connected for operation by said key plugs and arranged to make locking engagement with such post.

17. A lock mechanism as in claim 15 with the addition of an armor liner between said cup-shaped guard and said lock body.

18. A lock mechanism, comprising a post or the like to which a retaining lock is to be secured, a lock body having a post-receiving recess and adapted to be engaged over said post in retaining and non-rotating relation therewith, two opposite lock core-receiving chambers formed in said lock body for the reception of two lock cores, each having a key plug, with the key plugs rotatable on a common axis, p1 two lock cores mounted in said chambers, a rotatable control member mounted for rotation on said axis between said key plugs and connected to both key plugs to interconnect the same, means including said control member for securing said lock body on said post, and a guard rotatably mounted on said body and operative to prevent simultaneous insertion of keys in said two cores, said guard being movable between one position in which it covers one core key plug and exposes the other, and a second position in which it exposes said one core and covers the other. l

19. A lock mechanism as in claim 18 in which said lock body is in the form of a circular disk, and said guard is a cup-shaped member having a side wall surrounding the periphery of said body and extending behind the same, said side wall having an inwardly-open groove therein, and a retaining member mounted against the rear of the body and engaged in said groove to retain the guard on the body in rotative relation therewith.

20. A pick-resistant lock adapted to be secured over a retaining post or the like, comprising a lock body having a post-receiving recess extending inward from its rear face and adapted to be engaged in non-rotating relationship over a retaining post, two separate lock cores mounted in said body and having key plugs therein with key slots presented at spaced points on said body, means interconnecting the key plugs of said cores for joint rotation and preventing their independent rotation, said lock including a bolt or the like connected for joint operation by said key plugs, and a guard rotatably mounted on said body over said key slots and movable to expose said key slots not more than one at a time for key insertion therein and operative to block key insertion at any slot not so exposed.

* * * * *

UNITED STATES PATENT OFFICE

CERTIFICATE OF CORRECTION

Patent No. 4,026,132 Dated May 31, 1977

Inventor(s) Walter E. Best

It is certified that error appears in the above-identified patent and that said Letters Patent are hereby corrected as shown below:

Column 1, line 37, after "one", insert --core--.

Column 6, line 3 (claim 11), change "forward" to --formed--.

Column 7, lines 33 and 34 (claim 18), delete the mark "pl" after the comma in line 33, and transfer the following portion of the line to the beginning of the next line 34.

Column 8, line 9 (claim 18), delete the mark "I" after "other"

Signed and Sealed this

*Twenty-seventh* Day of *September 19*

[SEAL]

*Attest:*

RUTH C. MASON
*Attesting Officer*

LUTRELLE F. PARKER
*Acting Commissioner of Patents and Trademar*